US007874819B2

(12) United States Patent
North

(10) Patent No.: US 7,874,819 B2
(45) Date of Patent: Jan. 25, 2011

(54) MARKED TUBE FOR A PERISTALTIC PUMP

(75) Inventor: James A. North, Grayslake, IL (US)

(73) Assignee: Cole-Parmer Instrument Company, Vernon Hills, IL (US)

( * ) Notice: Subject to any disclaimer, the term of this patent is extended or adjusted under 35 U.S.C. 154(b) by 998 days.

(21) Appl. No.: 11/677,283

(22) Filed: Feb. 21, 2007

(65) Prior Publication Data

US 2007/0243088 A1 Oct. 18, 2007

Related U.S. Application Data

(60) Provisional application No. 60/744,696, filed on Apr. 12, 2006.

(51) Int. Cl.
*F04B 45/06* (2006.01)
*F16L 55/00* (2006.01)

(52) U.S. Cl. ..... 417/477.12; 138/104

(58) Field of Classification Search ..... 417/477.12; 138/104
See application file for complete search history.

(56) References Cited

U.S. PATENT DOCUMENTS 2,449,265 A 9/1948 Williams
3,565,554 A * 2/1971 Muller ..... 417/477.12
4,029,441 A * 6/1977 Fischer ..... 417/477.12
4,231,725 A 11/1980 Hogan
4,315,718 A 2/1982 Hogan
4,416,309 A 11/1983 Salim
4,452,599 A * 6/1984 Albisser et al. ..... 604/500
4,496,295 A * 1/1985 King ..... 417/477.12
4,552,516 A 11/1985 Stanley
4,886,431 A 12/1989 Soderquist et al.
5,082,429 A 1/1992 Soderquist et al.
5,230,614 A * 7/1993 Zanger et al. ..... 417/477.9
5,257,917 A 11/1993 Minarik et al.
5,380,173 A 1/1995 Hellstrom
5,482,447 A 1/1996 Sunden et al.
5,983,949 A 11/1999 Pohle
6,494,693 B1 12/2002 Sunden

OTHER PUBLICATIONS

International Searching Authority/US, International Search Report, International Application No. PCT/US07/66046, Apr. 7, 2008 (8 pages).
Cole-Parmer Instrument Company, B/T® Pump Selection Guide, pp. 126-132.

* cited by examiner

*Primary Examiner*—Charles G Freay
(74) *Attorney, Agent, or Firm*—Wood, Herron & Evans, LLP

(57) ABSTRACT

A tube is provided for use in a peristaltic pump, with the tube including a cylindrical wall defining a hollow interior and a cylindrical outer surface. The tube further includes a longitudinal centerline axis and a plurality of indicia applied to the cylindrical outer surface, with the indicia including first and second indicium extending transversely to the longitudinal centerline axis. The second indicium is longitudinally spaced from the first indicium by a predetermined distance.

5 Claims, 3 Drawing Sheets

MARKED TUBE FOR A PERISTALTIC PUMP

The present application claims the filing benefit of U.S. Provisional Application Ser. No. 60/744,696, filed Apr. 12, 2006, the disclosure of which is incorporated herein by reference in its entirety.

FIELD OF THE INVENTION

The present invention relates generally to pumps, and more particularly, to peristaltic pumps for moving fluid through a fluid carrying tube mounted within the pump.

BACKGROUND OF THE INVENTION

Peristaltic pumps are well known, having various configurations and applications. One configuration of a peristaltic pump has five primary elements comprising a rotor assembly, an occlusion bed, a tubing retainer system, tubing and a power source to drive the rotor assembly. The rotor assembly may be comprised of rollers, each having the same diameter and equally spaced circumferentially. The axis of each roller is the same distance from, and parallel to the axis of the driven shaft of the rotor assembly. The occlusion bed provides a surface for the rollers of the rotor assembly to compress the tubing against, while the tubing retainer system captures the tubing and holds it in position. The tubing must be made of a material with sufficient elastic properties to recover its shape after being compressed by the rollers.

During operation, the pump functions by compressing the tubing between the rotor and the occlusion bed along the rollers radial path. This compression of the tubing gives the pump its positive displacement action, moving the fluid in the tube while preventing backflow. The retainers hold the tubing in position at the entrance and exit of the roller/occlusion bed path. As the rollers move against the tubing, a pushing force is transmitted to the tube.

Peristaltic pumps having the foregoing configuration have been successfully used commercially in a wide variety of applications. However, pumps of this type can provide various manufacturing and/or installation challenges. For example, the consequence of the force transmitted to the tube can cause the tubing on the output side of the roller path to bunch in the space between the occlusion bed and its retainer. The only solution to overcome the bunching problem is proper installation of the tubing. Unfortunately, there is a certain amount of learned technique required. The technique, acquired only by experience, is needed to ensure the proper amount of tubing is placed between the retainers. The required length of tubing between the retainers tends to be subjective and is therefore a matter of opinion by a new user during installation. Additionally, the amount of tension in the tubing required for proper operation varies with the different tubing materials.

The industry standard practice to accomplish proper tube positioning is to provide a tubing "set". Tubing sets consist of a given length of tube with attached retaining features on each end that interface with the pump retainers. For example, each end of the tube may be inserted into a coupling which is held in place by a tube retaining device of the pump. This tubing set must be then coupled with other lengths of the tubing to complete the intended circuit.

Based on the foregoing, it may be appreciated that the potential drawbacks of known peristaltic pumps of the type discussed include improper tube installation and the requirement for multiple connections precluding the use of a single length of tubing in the fluid flow circuit thereby requiring additional assembly time.

SUMMARY OF THE INVENTION

The present invention overcomes the foregoing and other shortcomings of peristaltic pumps heretofore known. While the invention will be described in connection with certain embodiments, it will be understood that the invention is not limited to these embodiments. On the contrary, the invention includes all alternatives, modifications and equivalents as may be included within the spirit and scope of the present invention.

In view of the foregoing and according to a first aspect of the present invention, a tube is provided for use in a peristaltic pump that includes a cylindrical wall defining a hollow interior and a cylindrical outer surface. The tube further includes a longitudinal centerline axis and a plurality of indicia applied to the outer surface, with the indicia including first and second indicium extending transversely to the longitudinal centerline axis. The second indicium is longitudinally spaced from the first indicium by a predetermined distance.

In other embodiments, the tube may include one or more of the following features. The second indicium may be circumferentially spaced from the first indicium. The first and second indicium may be substantially perpendicular to the longitudinal centerline axis and the first and second indicia may extend completely around the cylindrical outer surface.

According to a second aspect of the present invention, a peristaltic pump is provided that includes a base and an occlusion bed movably mounted on the base, with the occlusion bed having an occlusion surface. The pump further includes a rotor assembly rotatably mounted on the base and including an end plate and a plurality of rollers rotatably mounted on the end plate. The pump further includes a motor drivingly coupled to the rotor assembly and a tube retaining device having an outer surface. The pump also includes a tube positioned between the rollers and the occlusion surface and captured within the tube retaining device. The tube includes a cylindrical wall defining a hollow interior and a cylindrical outer surface, a longitudinal centerline axis and a plurality of indicia applied to the outer surface, with the indicia comprising first and second indicium extending transversely to the longitudinal centerline axis. The first and second indicia are longitudinally spaced from one another by a predetermined distance and are substantially aligned with the outer surface of the tube retaining device.

In other embodiments, the first and second indicia may be circumferentially spaced from one another.

According to a third aspect of the present invention. a method is provided for installing a tube in a peristaltic pump having a base, an occlusion bed movably mounted on the base, a rotor assembly rotatably mounted on the base and including an end plate and a plurality of rollers mounted on the end plate. The pump further includes a tube retaining device mounted on the base and including an outer surface. The method includes the steps of applying a plurality of indicia to a cylindrical outer surface of the tube, with the indicia comprising first and second indicia extending transversely to a longitudinal centerline axis of the tube. The method further includes spacing the second indicium longitudinally from the first indicium by a predetermined distance, positioning the tube between the rollers and an occlusion surface of the occlusion bed and aligning the first indicium and the second indicium with the outer surface of the tube retaining device.

In other embodiments, the method may further include one or more of the following steps. The method may include spacing the second indicium circumferentially from the first indicium and may include applying the plurality of indicia completely around the cylindrical outer surface.

These and other objects and advantages of the present invention will be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENTS

Figure 1:
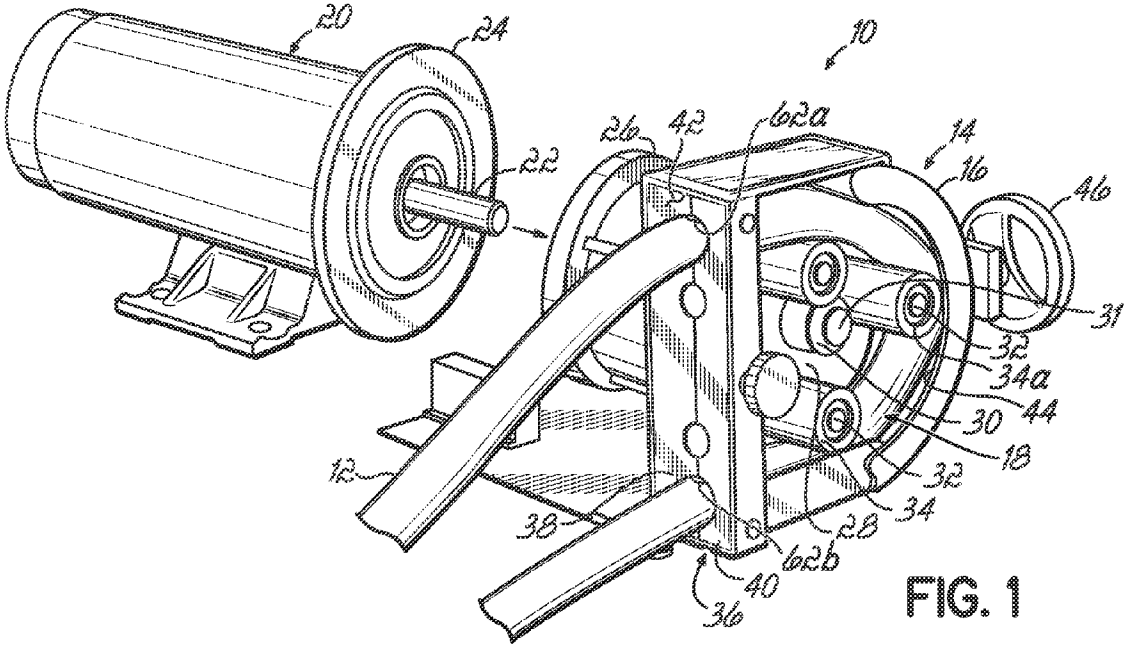
FIG. 1 is a perspective view of an exemplary peristaltic pump that can incorporate a tube according to the principles of the present invention.

Referring now to the drawings, FIG. 1 illustrates an exemplary peristaltic pump 10 that can incorporate a tube 12 according to the principles of the present invention. Pump 10 includes a stationary base 14, an occlusion bed 16 movably mounted on base 14 and a rotor assembly indicated generally at 18 that is rotatably mounted on base 14. Pump 10 further includes a motor 20, that can comprise an electric motor, having a rotatable output shaft 22. Motor 20 further includes a mount flange 24 that is used to secure the motor 20 to a speed reduction gearbox 26 of base 14 by conventional means such as fasteners (not shown). The output shaft 22 of motor 20 is drivingly coupled to gearbox 26.

The rotor assembly 18 includes an end plate 28 and a collar 30 secured to the end plate 28. The collar 30 receives the end of a gearbox output shaft 31 and is secured thereto, such that the rotor assembly 18 rotates with shaft 31. Rotor assembly 18 further includes a plurality of roller support pins 32 secured to the end plate 28 for rotation therewith, and a plurality of rollers 34. Each of the rollers 34 are rotatably mounted on one of the support pins 32 so that rollers 34 can rotate about the axis of rotation of the corresponding pin 32. Rollers 34 are equally spaced circumferentially and the axes of rotation of the pins 32 are equally spaced radially from the axis of rotation of motor shaft 22. A peripheral surface of the rollers 34 comprises the compression surface causing the pumping action of pump 10. Pump 10 further includes a tube retaining device 36 which is used to secure the tube 12 in place at the inlet and outlet of the pump 10 on base 14. The tube retaining device 36 includes a first portion 38 and a second portion 40 which is removably secured to portion 38 by conventional means such as fasteners. Each of the portions 38, 40 of the tube retaining device 36 include a substantially semi-circular bore formed therein for purposes of receiving tube 12. Tube retaining device 36 further includes an outer surface 42. The installation of tube 12 will be discussed subsequently in greater detail.

Figure 2:
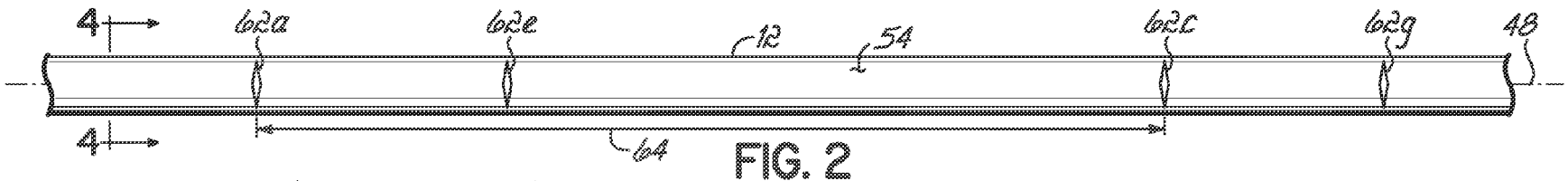
FIG. 2 is a top plan view of a tube according to the principles of the present invention.
Figure 3:
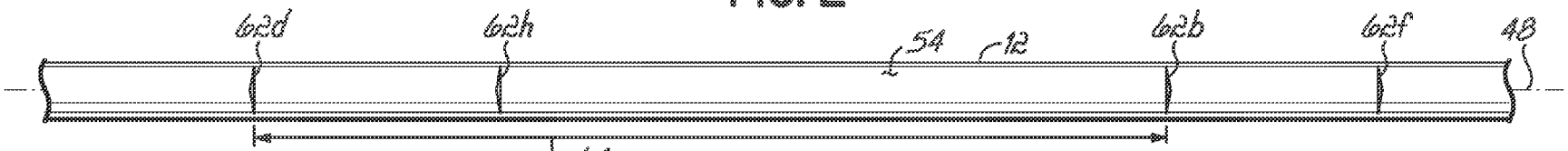
FIG. 3 is a bottom plan view of the tube shown in FIG. 2.
Figure 4:
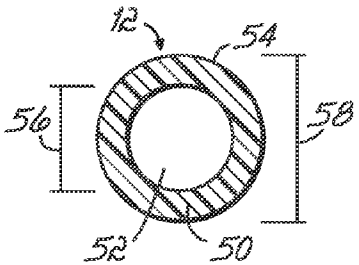
FIG. 4 is a cross-sectional view taken along line 4-4 in FIG. 2.

Referring now to FIGS. 2, 3 and 4, tube 12 is discussed in greater detail. Tube 12 includes a longitudinal centerline axis 48 and a cylindrical wall 50 that defines a hollow interior 52 and cylindrical outer surface 54. Tube 12 has an inside diameter 56 and an outside diameter 58. In one embodiment, pump 10 can be a batch transfer pump, for providing relatively high flow rates, although other pump configurations are possible as well. Accordingly, in one embodiment, the inside diameter 56 of tube 12 can be about 0.5 inch with the outside diameter 58 being about 1.0 inch, resulting in a thickness of wall 50 of about 0.25 inch. In another embodiment, the inside diameter 56 can be about 0.75 inch with the outside diameter 58 being about 1.25 inch, again resulting in a thickness of wall 50 of about 0.25 inch. However, the principles of the present invention can be applied to tubes having different inside and outside diameters and to tubes used in conjunction with peristaltic pumps having different configurations.

Tube 12 can be made of a material, such as various elastomers, which can withstand the high flexural fatigue exerted by rollers 34 on tube 12 and that can regain the cross-sectional shape of tube 12 after being occluded by rollers 34. Examples of suitable materials for tube 12 include, but are not limited to: Norprene®; Tygon® LFL; PharmaPure™; and platinum cured silicone such as BioPharm Plus silicone. Various polymers, such as Teflon®, can also be used to manufacture tube 12.

In accordance with the principles of the present invention, a plurality of markings or indicia can be applied to the outer cylindrical surface 54 of tube 12 for purposes of properly installing tube 12 in pump 10, while tube 12 retains a continuous length, as opposed to known tubes that can engage couplings retained by a tube retaining system. In one embodiment, the indicia may include a first pair of indicia, corresponding to an indicium 62*a* and an indicium 62*b* that are longitudinally spaced from one another and are located on opposite sides of the tube 12 (i.e., FIG. 2 shows the top side and FIG. 3 shows the bottom side). The applied indicia may also include a second pair of indicia corresponding to indicium 62*c* and 62*d*. As shown in the top view of FIG. 2, indicia 62*a* and 62*c* are longitudinally spaced from one another by a distance 64. As shown in the bottom view of FIG. 3, indicia 62*d* and 62*b* are also longitudinally spaced from one another by the distance 64. For ease of illustration, indicia 62*a* and 62*d* are located at the same longitudinal position on tube 12 (on opposite sides thereof) and indicia 62*b* and 62*c* are located at the same longitudinal position on tube 12 (again, on opposite sides thereof). Accordingly, the pair of indicia 62*a* and 62*b* are separated by distance 64 and the second pair of indicia 62*c* and 62*d* are also separated by distance 64.

Distance 64 corresponds to the desired length of tube 12 when installed in a particular pump. As shown in FIGS. 2 and 3, indicia 62*a*, 62*b*, 62*c* and 62*d* may extend transversely to the longitudinal centerline axis 48, and each may be perpendicular to the centerline axis 48. Additionally, as shown by the top plan view illustrated in FIG. 2 and the bottom plan view illustrated in FIG. 3, indicia 62*a* and 62*b* may be circumferentially spaced from one another, and this spacing may be about 180 degrees. Similarly, indicia 62*c* and 62*d* may be circumferentially spaced from one another and this spacing may be about 180 degrees.

Indicia 62*a* and 62*b* may be used to ensure that tube 12 is properly installed within pump 10. More particularly, indicia 62*a* and 62*b* may be used to ensure that the proper length of tube 12 is installed in the tube retaining device 36 of pump 10 between the pump inlet and pump outlet. This can be accomplished by installing tube 12 as follows. The second portion 40 of the tube retaining device 36 is separated from the first portion 38 of the tube retaining device 36, and the occlusion bed 16 is opened using knob 46. Tube 12 is then positioned between rollers 34 and an occlusion surface 44 (shown in FIGS. 1 and 5) of occlusion bed 16 and is also positioned within the semi-circular bores formed in the portion 38 of the tube retaining device 36 at the pump inlet and outlet locations. Indicium 62*a* is aligned with the outer surface 42 of the first portion 38 of the tube retaining device 36 at one of the pump inlet and pump outlet locations and tube 12 is adjusted as required so that indicium 62*b* is aligned with the outer surface 42 at the other of the pump inlet and outlet locations. For the convenience of the installer of tube 12, either the pair of indicia 62*a*, 62*b* or the pair of indicia 62*c*, 62*d* may be used to properly install tube 12, depending on the orientation of tube 12.

Figure 5:
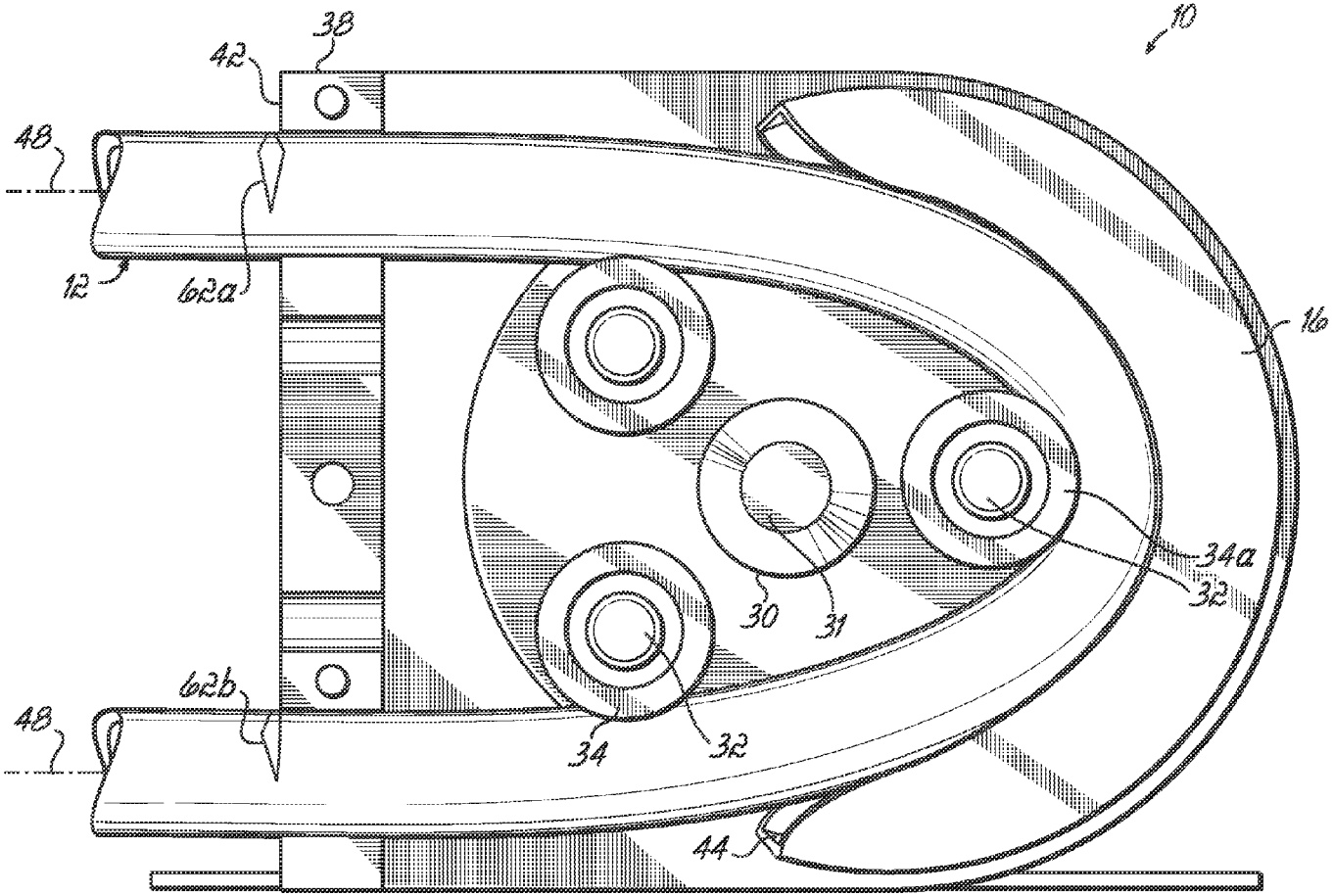
FIG. 5 is an elevation view illustrating the tube shown in FIGS. 2 and 3 installed in the pump shown in FIG. 1.

After tube 12 is properly installed, the second portion 40 of tube retaining device 36 is secured to the first portion 38 and the occlusion bed 16 is closed using knob 46. As best seen in FIG. 5, where portions of pump 10 are not shown for purposes of illustration, tube 12 is partially occluded between roller 34*a* and the occlusion surface 44. The degree of occlusion can be adjusted with the occlusion knob 46 shown in FIG. 1, but not shown in FIG. 5. When portions 38 and 40 of the tube retaining device 36 are secured to one another as shown in FIG. 1, tube 12 is secured so it cannot move relative to base 14 at the pump inlet and pump outlet. Pump 10 is then ready for operation.

After pump 10 is operated for a period of time, the portion of tube 12 being occluded can fatigue. Instead of replacing tube 12, the position of tube 12 within pump 10 can be changed so that a different portion of tube 12 is occluded and tube 12 is realigned using additional indicia. For example, indicia 62*e* and 62*f* may be applied to surface 54 such that they are circumferentially spaced from one another and are longitudinally spaced by a distance equal to distance 64. As shown in FIGS. 2 and 3, indicium 62*e* is longitudinally spaced from indicium 62*a* and can be used in lieu of indicium 62*a*. Similarly, indicium 62*f* is longitudinally spaced from indicium 62*b* and can be used in lieu of indicium 62*b*. Also, for the convenience of the installer of tube 12, indicium 62*g* may be used in lieu of indicium 62*a* and indicium 62*h* may be used in lieu of indicium 62*b*, depending on the orientation of the tube 12.

The indicia of the present invention may be applied to surface 54 by various methods including, but not limited to the following. For example, the indicia may be automatically located with the desired incremental spacing using pad-printing rollers with a diameter compatible with the outside diameter 58 of tube 12. Also, the use of an indexing device may move the tube the required distance to allow an indicium to be sprayed or pad printed in the right location. Other conventional means may be used to apply the indicia of the present invention to the outer surface 54 of tube 12.

Figure 6:
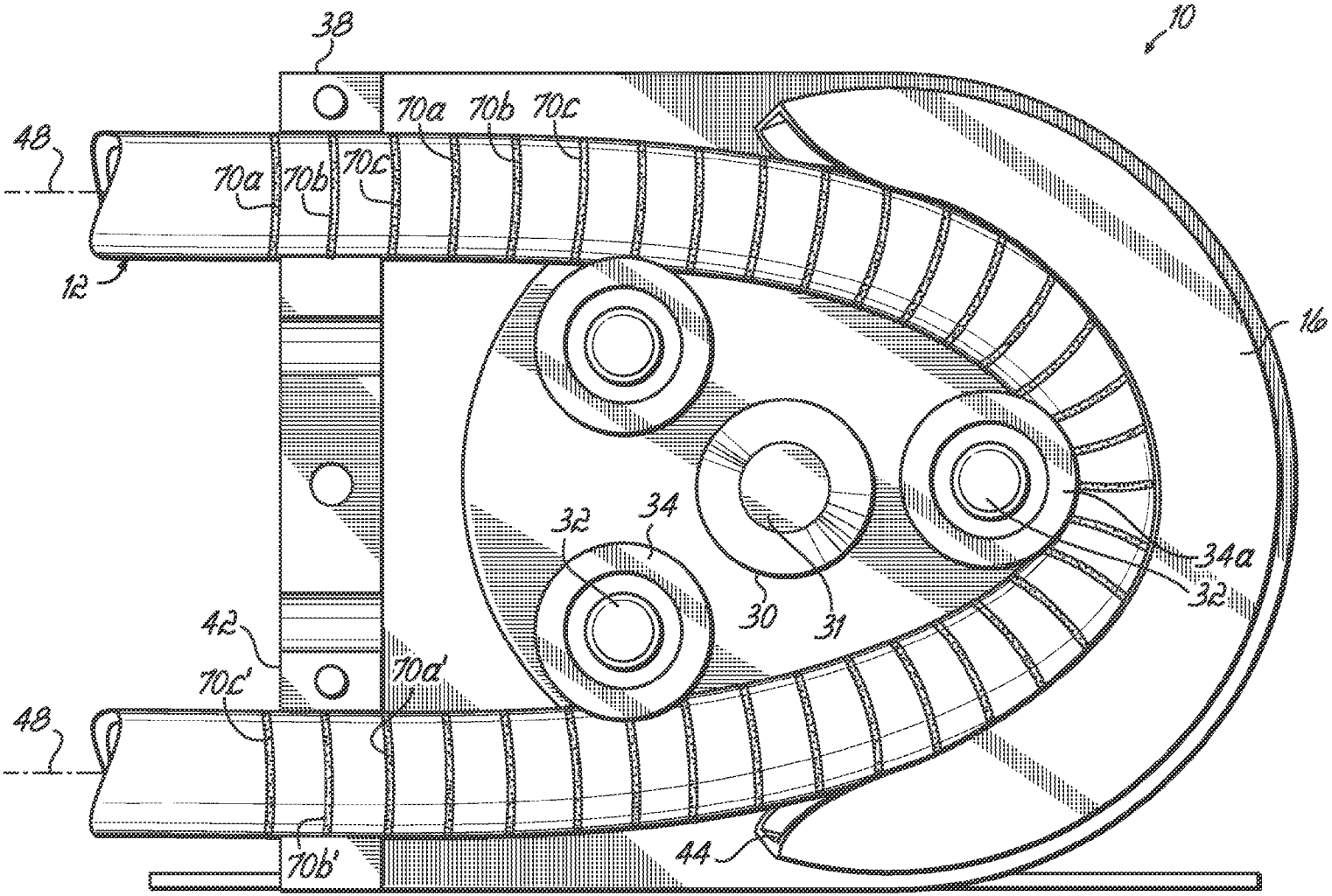
FIG. 6 is an elevation view similar to FIG. 5, but with alternate indicia applied to the illustrated tube.

The indicia of the present invention may have a wide variety of configurations, including but not limited to the following examples. The indicia may comprise solid lines, dashed lines, dots, geometric shapes or combinations thereof. Additionally, the indicia may extend around a portion of the circumference of the outer surface 54 transverse to axis 48 as shown in FIGS. 1,2,3 and 5, or they may extend around the entire circumference of surface 54, transverse to axis 48 as shown in FIG. 6 and described subsequently. Certain configurations may be used to identify particular pump types or models to facilitate operator recognition of the appropriate tube. Also, the indicia may have various colors, which may also be matched with certain pump types or models.

FIG. 6 illustrates a plurality of indicia 70 that are applied to tube 12 and extend completely around the circumference of tube 12, perpendicular to the longitudinal centerline axis 48. The indicia 70 may be equally spaced or may have varying spacings. For example, the indicia 70 may be applied in repeating sets such as 70*a*, 70*b* and 70*c*. A first indicium 70*a* and a second indicium 70*a*' can be separated longitudinally by the previously discussed distance 64. Accordingly, this pair of indicia 70*a* and 70*a*' may be used to install tube 12 in pump 10, such that each is aligned with surface 42 of the first portion 38 of the tube retaining device 36, at one of the pump inlet and pump outlet locations as discussed previously with respect to indicia 62*a* and 62*b*. For ease of identification, the various sets of indicia 70 can be color coded or have different shapes, so that adjacent ones of the indicia 70 have different colors or shapes. For example, each indicium 70*a* may be a red line, each indicium 70*b* may be a blue line and each indicium 70*c* may be a green line. Each of the indicia 70*a*, 70*b* and 70*c* can correspond to the same model pump, such that the distance 64 between the first indicium 70*a* and the second indicium 70*a*' positioned at the pump inlet and outlet locations, respectively, is the same as equivalent pairs of indicia 70*b* and 70*c*.

As noted previously, after pump 10 is operated for a period of time, the portion of tube 12 being occluded can fatigue. In this event, it is not necessary to replace tube 12. Instead, a pair of indicia 70*b* or a pair of indicia 70*c* can be used in lieu of the indicia 70*a* and 70*a*' so that the position of tube 12 within pump 10 can be changed within the tube retaining device 36 so that a different portion of tube 12 is occluded.

However, indicia 70*a*, 70*b* and 70*c* may be spaced as required to accommodate pumps of different sizes. While each set of indicia 70 includes three different indicia 70*a*, 70*b* and 70*c*, for purposes of illustration, different numbers of indicia 70 can be applied in repeating sets along the length of tube 12 within the scope of the present invention.

While the present invention has been illustrated by the description of an exemplary embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A peristaltic pump comprising:

a base;

an occlusion bed movably mounted on said base, said occlusion bed having an occlusion surface;

a rotor assembly rotatably mounted on said base and including an end plate and a plurality of rollers rotatably mounted on said end plate;

a motor drivingly coupled to said rotor assembly;

a tube retaining device mounted on the base and having an outer surface; and a tube positioned between said rollers and said occlusion surface and secured within said tube retaining device, wherein said tube comprises a cylindrical wall defining a hollow interior and a cylindrical outer surface, a longitudinal centerline axis and a plurality of markings applied to said outer surface, said markings comprising first and second markings extending transversely to said longitudinal centerline axis;

said first and second markings are longitudinally spaced from one another by a predetermined distance;

said first marking and said second marking are substantially aligned with said outer surface of said tube retaining device.

2. A peristaltic pump as recited in claim 1, wherein:

said first and second markings are circumferentially spaced from one another.

3. A method for installing a tube in a peristaltic pump having a base, an occlusion bed movably mounted on the base, a rotor assembly rotatably mounted on the base and including an end plate and a plurality of rollers mounted on the end plate, and a tube retaining device mounted on the base and including an outer surface, said method comprising the steps of:

applying a plurality of markings to a cylindrical outer surface of the tube, the markings comprising first and second markings extending transversely to a longitudinal centerline axis of the tube;

spacing the second marking longitudinally from the first marking by a predetermined distance;

positioning the tube between the rollers and an occlusion surface of the occlusion bed; and aligning the first marking and the second marking with the outer surface of the tube retaining device and securing the tube within the tube retaining device.

4. A method as recited in claim 3, further comprising:

spacing the second marking circumferentially from the first marking.

5. A method as recited in claim 2, further comprising:

applying the plurality of markings completely around the cylindrical outer surface.

* * * * *

UNITED STATES PATENT AND TRADEMARK OFFICE

CERTIFICATE OF CORRECTION

PATENT NO. : 7,874,819 B2
APPLICATION NO. : 11/677283
DATED : January 25, 2011
INVENTOR(S) : James A. North It is certified that error appears in the above-identified patent and that said Letters Patent is hereby corrected as shown below:

In column 1, line 9, change "relates generally to pumps, and more particularly, to peristaltic pumps" to --relates generally to pumps and, more particularly, to peristaltic pumps--.

In column 3, line 50, change "Each of the rollers 34 are rotatably" to --Each of the rollers 34 is rotatably--.

In column 3, line 63, change "Each of the portions 38, 40 of the tube retaining device 36 include a substantially" to --Each of the portions 38, 40 of the tube retaining device 36 includes a substantially--.

In claim 3, column 8, line 6, change "surface of the occlusion bed; and" to --surface of the occlusion bed;--, as appears in the Notice of Allowance, Examiner's Amendment, dated October 18, 2010 at Page 2, paragraph 7, was claim 7, now claim 3.

In claim 3, column 8, line 8, change "retaining device and securing the tube within the tube retaining device." to
--retaining device; and
securing the tube within the tube retaining device.--,
as appears in the Notice of Allowance, Examiner's Amendment, dated October 18, 2010 at Page 2, paragraph 8, was claim 7, now claim 3.

Signed and Sealed this
Thirty-first Day of May, 2011

David J. Kappos

David J. Kappos
*Director of the United States Patent and Trademark Office*